US006226834B1

(12) United States Patent
Lu

(10) Patent No.: US 6,226,834 B1
(45) Date of Patent: May 8, 2001

(54) HANDLE STRUCTURE FOR A LUGGAGE

(75) Inventor: Lien-Ching Lu, Mioa Li (TW)

(73) Assignee: Ting Cheng Co., Ltd., Miao Li Hsien (TW)

( * ) Notice: Subject to any disclaimer, the term of this patent is extended or adjusted under 35 U.S.C. 154(b) by 0 days.

(21) Appl. No.: 09/481,932

(22) Filed: Jan. 13, 2000

(51) Int. Cl.[7] ..... A45C 7/00; A45C 13/22

(52) U.S. Cl. ..... 16/113.1; 190/115; 190/18 A; 280/655; 280/655.1

(58) Field of Search ..... 16/113.1; 280/655, 280/655.1, 47.315, 47.371; 190/115, 18 A

(56) References Cited

U.S. PATENT DOCUMENTS 5,624,012 * 4/1997 Wang ..... 16/113.1
5,630,250 * 5/1997 Chou ..... 16/113.1
5,636,410 * 6/1997 Chou ..... 16/113.1
5,729,866 * 3/1998 Chg ..... 16/113.1
5,996,177 * 12/1999 Cheng ..... 16/113.1

* cited by examiner

*Primary Examiner*—Chuck Y. Mah
(74) *Attorney, Agent, or Firm*—Rosenberg, Klein & Lee

(57) ABSTRACT

A luggage handle structure includes a handle, two inner tubes, two linking rods, two inner locking tubes, and two outer tubes. The handle includes an upper cap having a mediate portion defining a hollow recess and two sides each defining a cut slot, the hollow recess having two sides each formed with a hollow lower lug; a press plate having a mediate portion defining a chamber and two sides each formed with a protruding wing received in the cut slot of the upper cap, the protruding wing defining a through hole for receiving the lower lug of the upper cap, a spring received in the chamber; and a base having two sides each formed with an insertion block received in the cut slot of the upper cap and a hollow upper lug formed on an inner side of the insertion block, the upper lug aligning with the lower lug, a bolt extending through the upper lug and screwed into the lower lug to form a retaining column, a stub formed on the mediate portion of the base and attached to the spring.

1 Claim, 5 Drawing Sheets

HANDLE STRUCTURE FOR A LUGGAGE

FIELD OF THE INVENTION

The present invention relates to a handle structure for a luggage.

DESCRIPTION OF THE RELATED ART

A conventional handle for a luggage includes two pull rods directly mounted in the handle. When a user wishes to adjust the height of the pull rods of the handle, he/she has to exert a large force to press the pull rods by pressing the handle so as to adjust the height of the pull rods. If the forces exerted on the two pull rods are not even or balanced, the heights of the two pull rods are not in concert with each other, thereby easily damaging the outer tubes of the handle. The present invention has arisen to mitigate and/or obviate the disadvantage of the conventional luggage handle.

BRIEF SUMMARY OF THE INVENTION

In accordance with one aspect of the present invention, there is provided a handle structure for a luggage comprising a handle, two inner tubes, two linking rods, two inner locking tubes, and two outer tubes.

The handle comprises an upper cap having a mediate portion defining a hollow recess and two sides each defining a cut slot, the hollow recess having two sides each formed with a hollow lower lug; a press plate having a mediate portion defining a chamber and two sides each formed with a protruding wing received in the cut slot of the upper cap, the protruding wing defining a through hole for receiving the lower lug of the upper cap, a spring received in the chamber; and a base having two sides each formed with an insertion block received in the cut slot of the upper cap and a hollow upper lug formed on an inner side of the insertion block, the upper lug aligning with the lower lug, a bolt extending through the upper lug and screwed into the lower lug to form a retaining column, a stub formed on the mediate portion of the base and attached to the spring.

Further benefits and advantages of the present invention will become apparent after a careful reading of the detailed description with appropriate reference to the accompanying drawings.

DETAILED DESCRIPTION OF THE INVENTION

Figure 1:
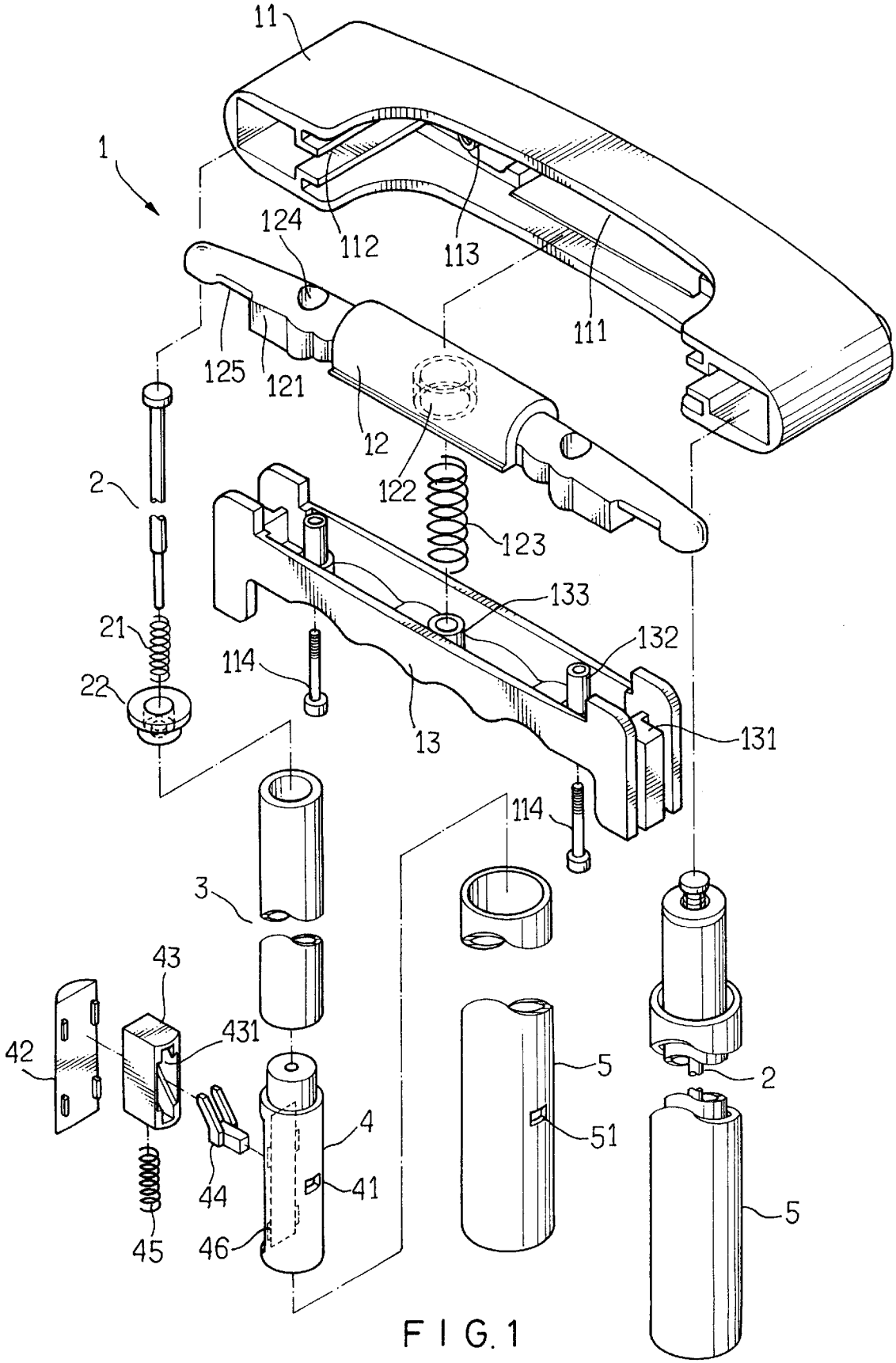
FIG. 1 is an exploded perspective view of a handle structure for a luggage in accordance with the present invention.

Referring to the drawings and initially to FIGS. 1–4, a handle structure for a luggage in accordance with the present invention comprises a handle 1, two inner tubes 3, two linking rods 2, two inner locking tubes 4, and two outer tubes 5.

Each of the inner tubes 3 has a washer 22 mounted on the upper end thereof, and a spring 21 received in the washer 22. Each of the linking rods 2 extends through the inner tube 3 from the handle 1 to the inner locking tubes 4. Each of the inner locking tubes 4 is secured to the lower end of the inner tube 3, and has an inner hole 41 defined therethrough. A push block 43 is secured to the lower end of each of the linking rods 2, and is movably mounted in each of the inner locking tubes 4. A power spring 45 is mounted on the bottom of the push block 43. A slide 44 is slidably mounted in an inclined slide slot 431 defined in the push block 43 so that the slide 44 can slide in the slide slot 431 of the push block 43 in an inclined manner. A cover 42 is attached to a retaining hole 46 defined in the inner locking tube 4 to cover the opening defined in one side of the inner locking tube 4. Each of the outer tubes 5 has a plurality of locking holes 51 defined therein to detachably receive the slide 44.

The handle 1 comprises an upper cap 11 having a mediate portion defining a hollow recess 111 and two sides each defining a cut slot 112, the hollow recess 111 having two sides each formed with a hollow lower lug 113; a press plate 12 having a mediate portion defining a chamber 122 and two sides each formed with a protruding wing 121 received in the cut slot 112 of the upper cap 11, the protruding wing 121 defining a through hole 124 for receiving the lower lug 113 of the upper cap 11 and defining a cutout 125 to be received in the cut slot 112, a spring 123 received in the chamber 122; and a base 13 having two sides each formed with an insertion block 131 received in the cut slot 112 of the upper cap 11 and a hollow upper lug 132 formed on an inner side of the insertion block 131, the upper lug 132 aligning with the lower lug 113, a bolt 114 extending through the upper lug 132 and screwed into the lower lug 113 to form a retaining column A, a stub 133 formed on the mediate portion of the base 13 and attached to the spring 123.

Figure 2:
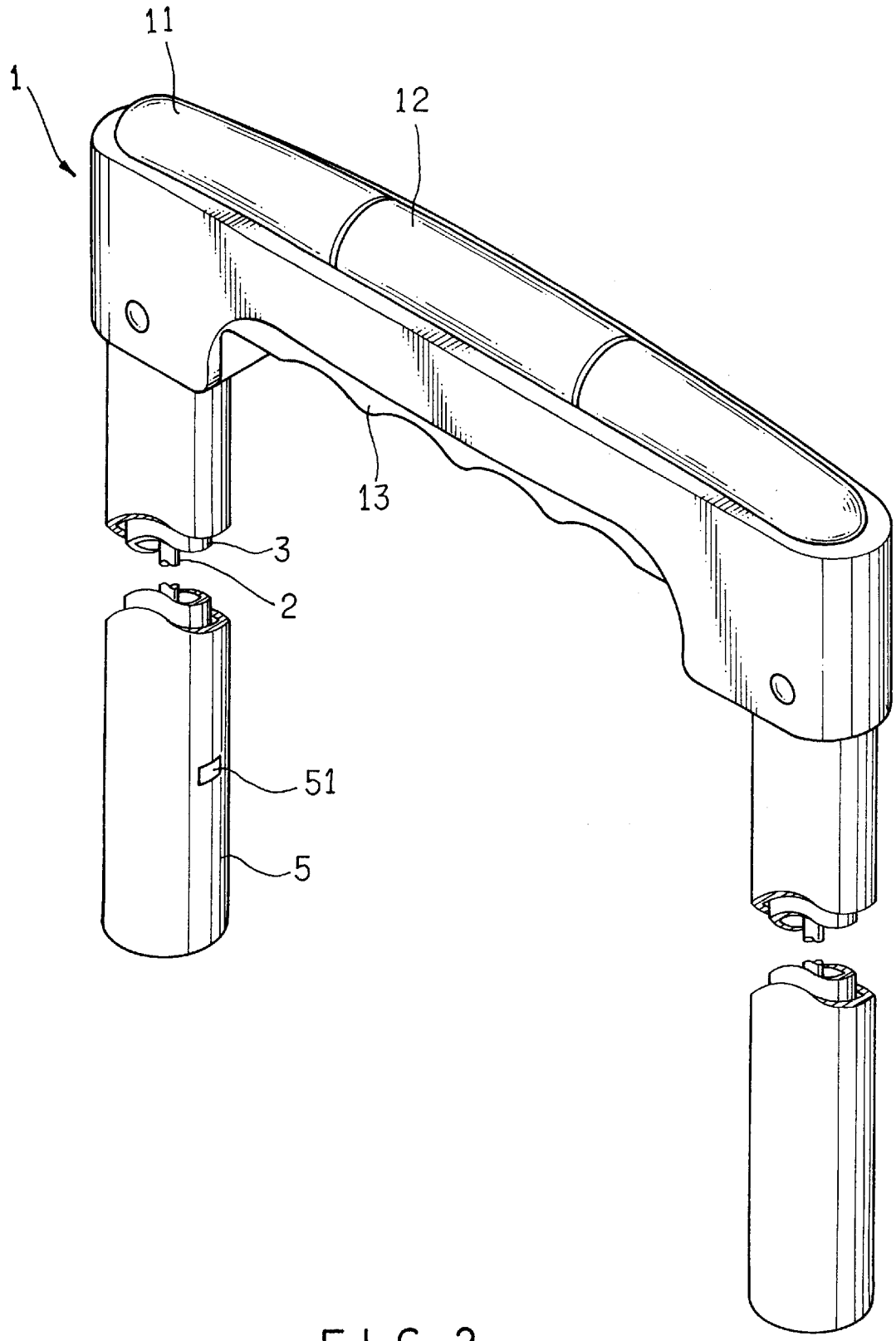
FIG. 2 is a perspective assembly view of the handle structure as shown in FIG. 1.
Figure 3:
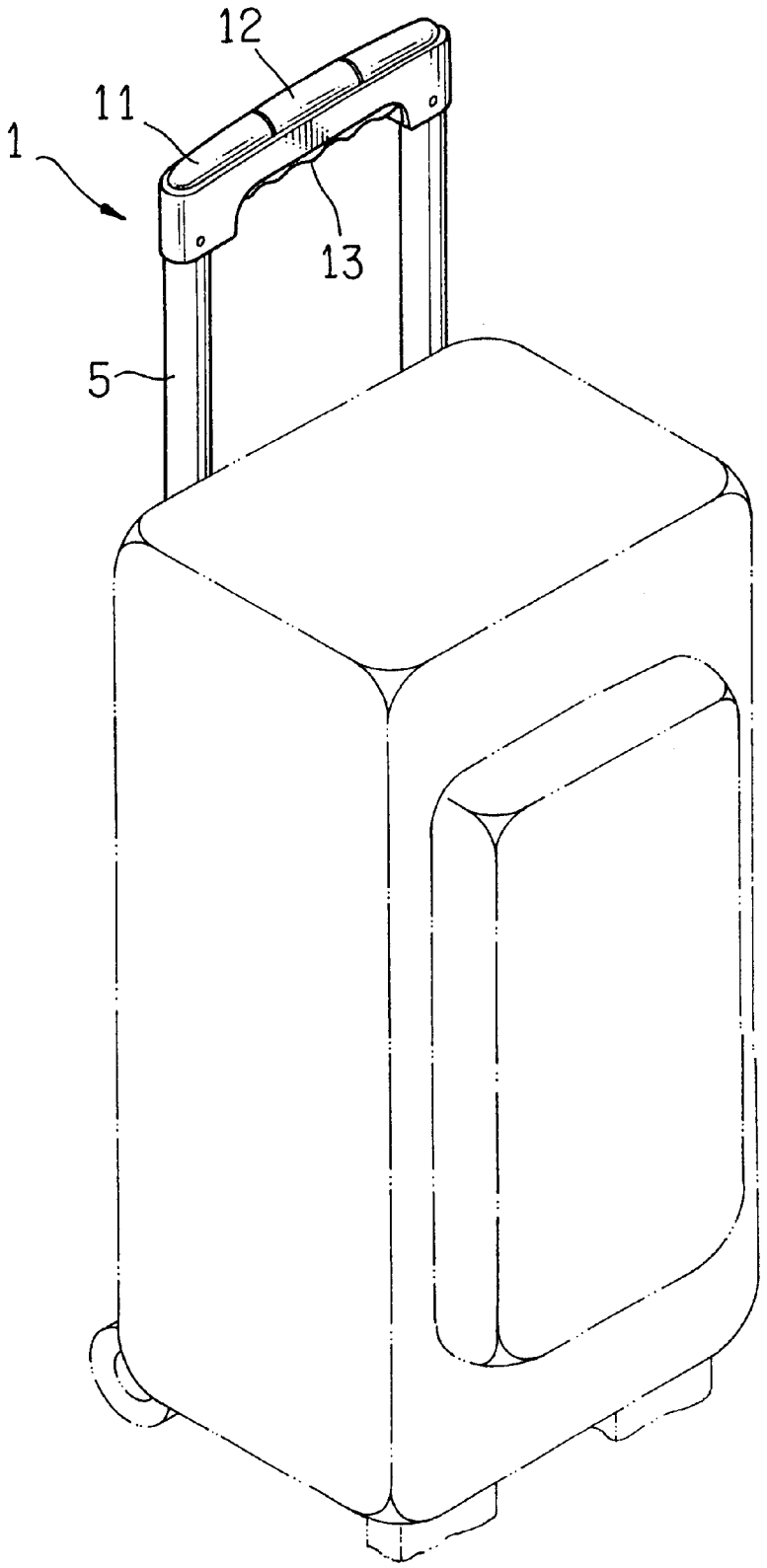
FIG. 3 is a schematic view showing the handle structure coupled with the luggage.
Figure 4:
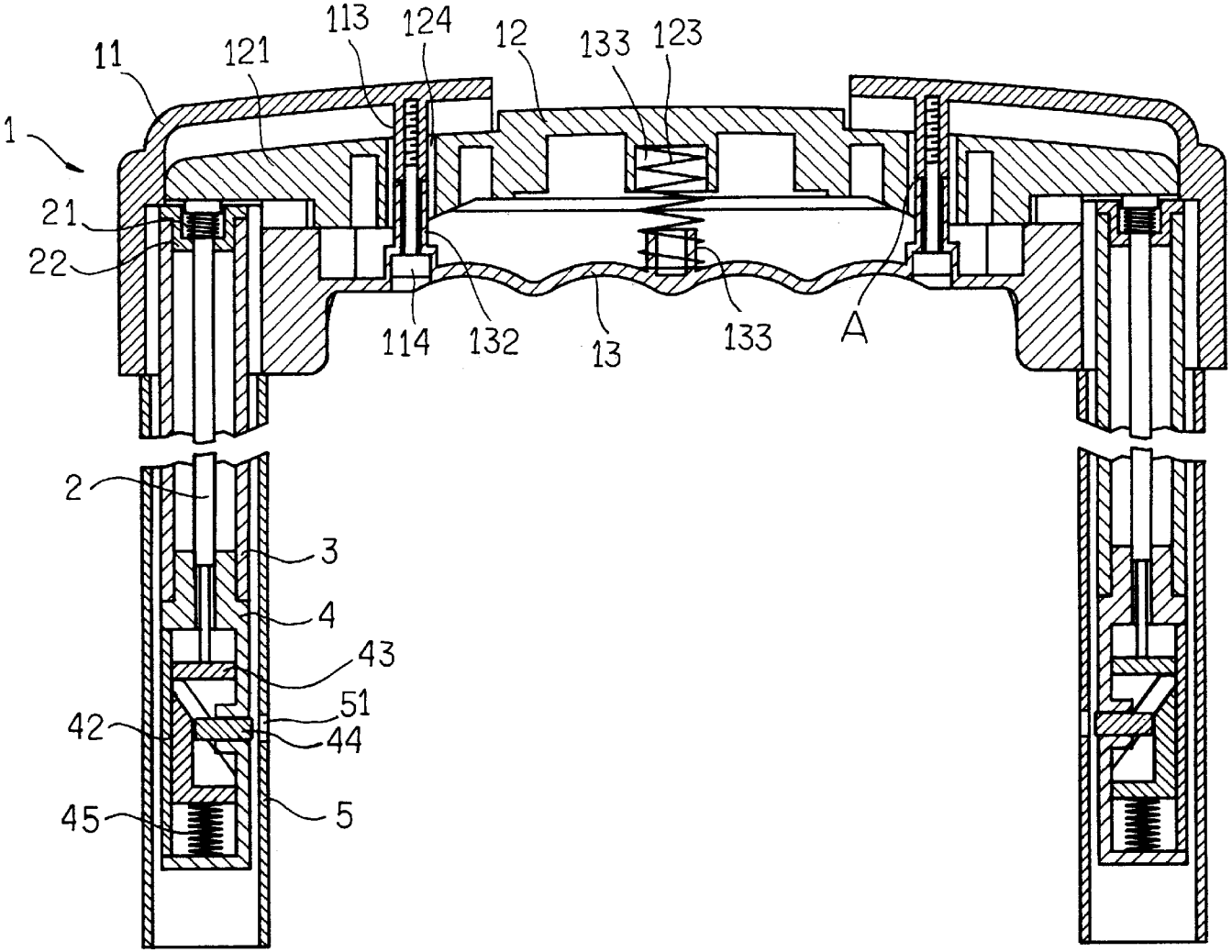
FIG. 4 is a front plan cross-sectional view of the handle structure as shown in FIG. 2.
Figure 5:
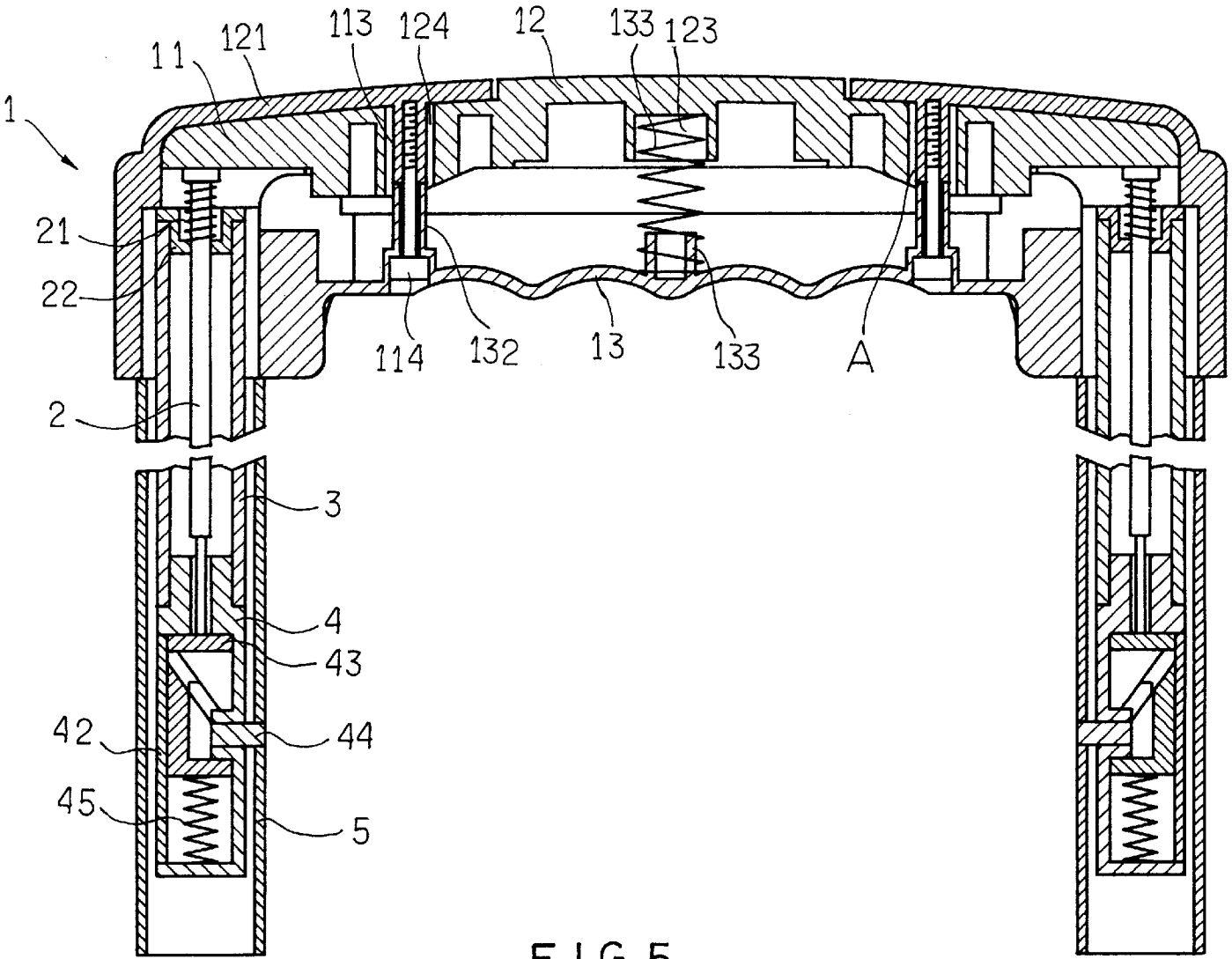
FIG. 5 is an operational view of the handle structure as shown in FIG. 4.

In operation, referring to FIGS. 4 and 5 with reference to FIGS. 1–3, when the press plate 12 is pressed downward, each of the linking rods 2 is moved downward to move the push block 43 downward to press the slide 44 which is able to slide in the slide slot 431 relative to the push block 43 to move from the position as shown in FIG. 5 to the position as shown in FIG. 4, thereby detaching the slide 44 from the locking hole 51 of the outer tube 5 so that the inner tubes 3 and the inner locking tubes 4 can be moved upward by lifting the base 13 and the upper cap 11, thereby adjusting the height of the handle 1 of the handle structure.

When the force exerted on the press plate 12 is removed, the press plate 12 is pressed upward by the restoring force of the spring 123, and the linking rod 2 is pressed upward by the restoring force of the spring 21, thereby moving the push block 43 upward to press the slide 44 which is able to slide in the slide slot 431 relative to the push block 43 to move from the position as shown in FIG. 4 to the position as shown in FIG. 5, thereby locking the slide 44 in the locking hole 51 of the outer tube 5 so that the inner tubes 3 and the inner locking tubes 4 are fixed in the outer tube 5, thereby securing the handle 1 of the handle structure.

It should be clear to those skilled in the art that further embodiments may be made without departing from the scope of the present invention.

What is claimed is:

1. A handle structure for a luggage, said handle structure comprising a handle (1), two inner tubes (3), two linking rods (2), two inner locking tubes (4), and two outer tube (5), the improvement comprising:

said handle (1) comprising:

an upper cap (11) having a mediate portion defining a hollow recess (111) and two sides each defining a cut slot (112), said hollow recess (111) having two sides each formed with a hollow lower lug (113);

a press plate (12) having a mediate portion defining a chamber (122) and two sides each formed with a protruding wing (121) received in said cut slot (112) of said upper cap (11), said protruding wing (121) defining a through hole (124) for receiving said lower lug (113) of said upper cap (11), a spring (123) received in said chamber (122); and a base (13) having two sides each formed with an insertion block (131) received in said cut slot (112) of said upper cap (11) and a hollow upper lug (132) formed on an inner side of said insertion block (131), said upper lug (132) aligning with said lower lug (113), a bolt (114) extending through said upper lug (132) and screwed into said lower lug (113) to form a retaining column (A), a stub (133) formed on the mediate portion of said base (13) and attached to said spring (123).

* * * * *